US005377383A

United States Patent [19]

Christensen

[11] Patent Number: 5,377,383

[45] Date of Patent: Jan. 3, 1995

[54] ATTACHMENT FOR A VACUUM CLEANER OR A VACUUM-CLEANING PIPE

[76] Inventor: Lars Christensen, Søndergade 24, DK-8783 Hornsyld, Denmark

[21] Appl. No.: 90,016

[22] PCT Filed: Jan. 28, 1991

[86] PCT No.: PCT/DK92/00030

§ 371 Date: Jul. 16, 1993

§ 102(e) Date: Jul. 16, 1993

[87] PCT Pub. No.: WO92/12664

PCT Pub. Date: Aug. 6, 1992

[30] Foreign Application Priority Data

Jan. 28, 1991 [DK] Denmark ..... 0150/91

[51] Int. Cl.[6] ..... A47L 7/00

[52] U.S. Cl. ..... 15/353; 15/344; 15/421; 55/219; 55/437; 55/465

[58] Field of Search ..... 15/353, 344; 55/219, 55/437, 465

[56] References Cited

U.S. PATENT DOCUMENTS

| | | | |
|---|---|---|---|
| 2,726,732 | 12/1955 | Faust et al. | 55/219 |
| 2,744,534 | 5/1956 | Faust et al. | 55/219 X |
| 4,041,569 | 8/1977 | Petersen | 15/353 |
| 4,055,405 | 10/1977 | Thun-Hohenstein | 15/353 X |
| 4,179,769 | 12/1979 | Lundquist | 15/353 |
| 4,246,676 | 1/1981 | Hallsworth et al. | 15/353 |
| 4,675,936 | 6/1987 | Rawlins | 15/353 |
| 4,821,367 | 4/1989 | McAllister et al. | 15/353 |
| 4,934,021 | 6/1990 | Lenting | 15/353 |
| 5,105,504 | 4/1992 | Brzoska | 15/353 X |
| 5,263,224 | 11/1993 | Lovelady | 15/353 |

FOREIGN PATENT DOCUMENTS

| | | | |
|---|---|---|---|
| 1465085 | 3/1989 | U.S.S.R. | 55/465 |

*Primary Examiner*—Chris K. Moore

*Attorney, Agent, or Firm*—McAulay Fisher Nissen Goldberg & Kiel

[57] ABSTRACT

To vacuum up a fluid using a vacuum cleaner, there is provided an attachment (1) to which a vacuum cleaner hose (31) is connected. The attachment comprises a separation chamber (3) in which the vacuumed up liquid is separated from the suction air through deposition on the wall surfaces (5, 6, 8, 11) of the separation chamber, with the liquid then dripping down into the collection chamber (21). The liquid is thus completely separated from the air using a common vacuum cleaner without the potential for vacuum cleaner damage. To insure that the suction through the attachment is cut off in the event that the liquid in the container reaches the vicinity of the suction channel, a valve element (18) and a float element (20) are provided which cut off the suction air and therewith the flow of liquid to the attachment when the maximum liquid level has been reached in the container. A finger operated valve can optionally cut off the suction through the attachment to regulate the vacuum.

7 Claims, 4 Drawing Sheets

ATTACHMENT FOR A VACUUM CLEANER OR A VACUUM-CLEANING PIPE

BACKGROUND OF THE INVENTION

The invention relates to an attachment, for a vacuum cleaner or a vacuum-cleaning pipe, for collecting vacuumed liquid. The attachment is configured as a closed container with a suction connection which leads to a nozzle and with a vacuum connection for a hose leading to the vacuum cleaner or the vacuum-cleaning pipe. A separation chamber is provided in the container and connected to the suction connection for the separation of the vacuumed liquid and collection in a collection chamber, with a float-controlled valve located between the collection chamber and the vacuum connection.

The increased use of carpets as floor covering has led to a rising need for the cleaning of this type of covering. Where dry dust is involved, the hitherto-used means is vacuum cleaning, which in most cases is also adequate for normal cleaning.

However, where the spillage of liquids occurs, for example drinks and the like, use must be made of other methods. This will mainly involve the vacuuming of the liquid and possible subsequent spot-cleaning by means of special fluids.

Furthermore, it is known to use specially-developed carpet-cleaning machines, which are normally used by professional cleaning personnel, and which therefore can seldom be considered for use in private homes.

Here it is necessary to use cleaning agents in fluid or foam form, which dissolve the stain and are thereafter removed by drying.

However, this form of spot-cleaning is not particularly effective, in that the amount of fluid is far too small, and thus the dissolving ability is vary limited. Since vacuum cleaning must not involve the vacuuming of air which contains liquid, there is consequently no help to be found in the use of a vacuum cleaner.

The removal of stains thus becomes troublesome, in that this must comprise a softening by means of the cleaning agent and a subsequent washing out of the cleaning agent from the carpet. This requires not only a considerable amount of liquid, but also a correspondingly large amount of work in the absorption of the liquid by means of absorption elements of material or paper. During this work, the liquid is spread in all directions, and a possible blotch formation could appear which would be of a relatively large extent.

To remedy these inconveniences, various attachments have been developed for vacuum cleaners, which can herewith vacuum up the liquid which exists on the carpet.

From the description of U.S. Pat. No. 4,179,769 there is known an attachment for the vacuuming and the separation of liquid. The attachment can be connected to a vacuum cleaner suction hose. In the suction of liquid, only to a certain degree will the liquid be separated from the air and collected in a collection container when a finger-operated valve opens to the vacuum through the attachment. Consequently, the separation of liquid is not particularly effective, and moreover there is a risk of the vacuuming in liquid when the level of the liquid in the collection container becomes too high.

This gives rise to the risk of damage to the vacuum cleaner motor because of the moisture content of the air. Furthermore, the load on the motor is very high in those cases where the valve is closed to the vacuum due to the flow of air being cut off.

From the description in EPO no. 0,188,250 there is known an attachment with a built-in float-controlled valve which serves to block the suction through the attachment when the liquid level gets too high.

This attachment is provided with a porous filter element through which the moist air is led, and in which the liquid separation takes place. However, this method of separation is not particularly expedient, the reason being that it results in a considerable reduction of the suction power, in that the formation of droplets will completely or partly block the passage of the air through the filter. Similarly, the airways become relatively short, whereby there is a risk of a liquid content in the air which is harmful for the vacuum cleaner motor. Thus, the equipment would involve a highly reduced suction effect and a low liquid separation.

Both of these types of attachments also suffer the disadvantage that they do not cut off the vacuum in the event of the surface of the liquid reaching the vacuum connection, which can happen if the container is tipped over or the attachment is tilted too much during its use.

ADVANTAGES OF THE INVENTION

The attachment according to the invention has as a characterizing feature that the suction connection is placed in the top of the container, where it opens into the separation chamber which comprises a channel system demarcated by wall surfaces, the undersides of which are located above the collection chamber and whose lower vertical surfaces are configured at the bottom with a drip edge, while on the underside of the horizontal surfaces there are provided drip cones resulting in a hitherto unattainable separation of the liquid from the vacuumed mixture of liquid and air, and without any significant reduction in the suction effect. Therefore, the attachment can be connected without risk to a normal vacuum cleaner, which makes the cleaning of stains on carpets in private homes a simple matter. This can be done by means of the attachment and a commonly-known vacuum cleaner. The attachment ensures that the content of moisture in the air is low, whereby the suction effect of the vacuum cleaner and also its electrical insulation properties are safely maintained.

An open channel system in the separation chamber with this configuration of the walls and the surfaces in the channel system will result in a surprisingly effective separation of the moisture. This is due partly to the turbulent flows imparted to the air in the chamber, whereby the air is effectively brought into contact with the surfaces, and partly due to the many drop-forming surfaces with which the walls and the surfaces of the chamber are provided.

The drip edges and the drip cones will thus in an effective manner promote the separation of the moisture, which quickly and effectively drips down into the collection container. As mentioned, this dripping down of the moisture takes place in an open channel system in such a manner that no restrictions are formed in the passage, and thus there is no loss of pressure in the attachment. This is of utmost importance for the applicability of the equipment, in that the high suction capacity provides an effective induction and herewith the drying of the moist part of the carpet.

By allowing the air to leave the chamber through a horizontal chamber with an upwardly-extending channel to the vacuum connection, it is ensured that the air does not contain residual moisture, in that the remaining moisture will be deposited on the walls of the chamber during its passage through the chamber, and any possible dripping will be led to the collection container.

By placing the shut-off valve in the top of the container and the float element in the bottom of the container, closing can be effected completely without the risk of overflow to the vacuum hose.

By mounting a finger-operated shut-off valve on the container, the attachment will lend itself to easy operation by the user during its use, and since air is led from the outside to the vacuum hose when the valve is closed, the vacuum cleaner motor is spared an overload as there will always be a flow of air in the vacuum hose.

BRIEF DESCRIPTION OF THE DRAWINGS

An example embodiment according to the invention is shown in the drawing, where.

DESCRIPTION OF THE INVENTION

Figure 1:
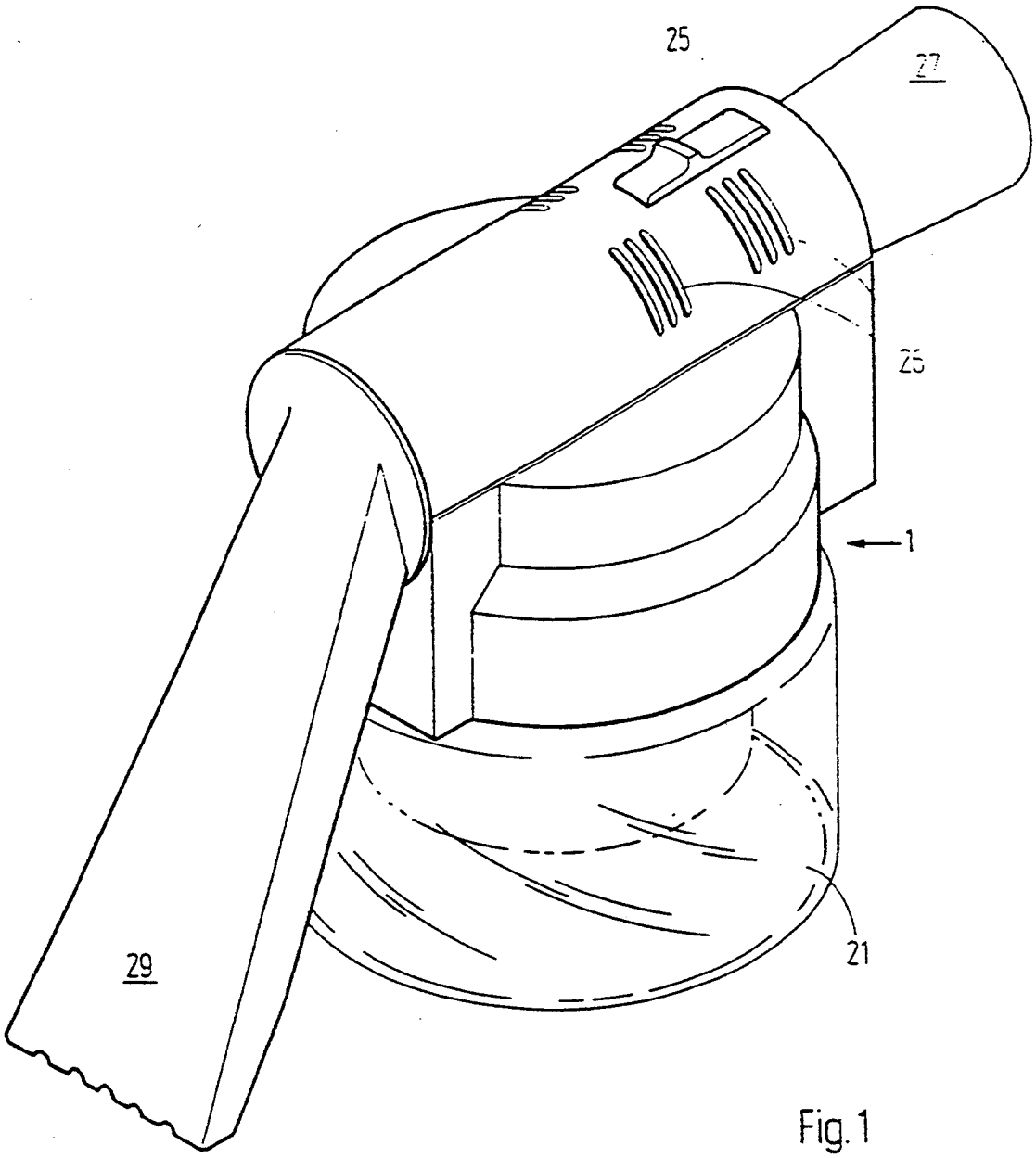
FIG. 1 shows the attachment seen in perspective.
Figure 4:
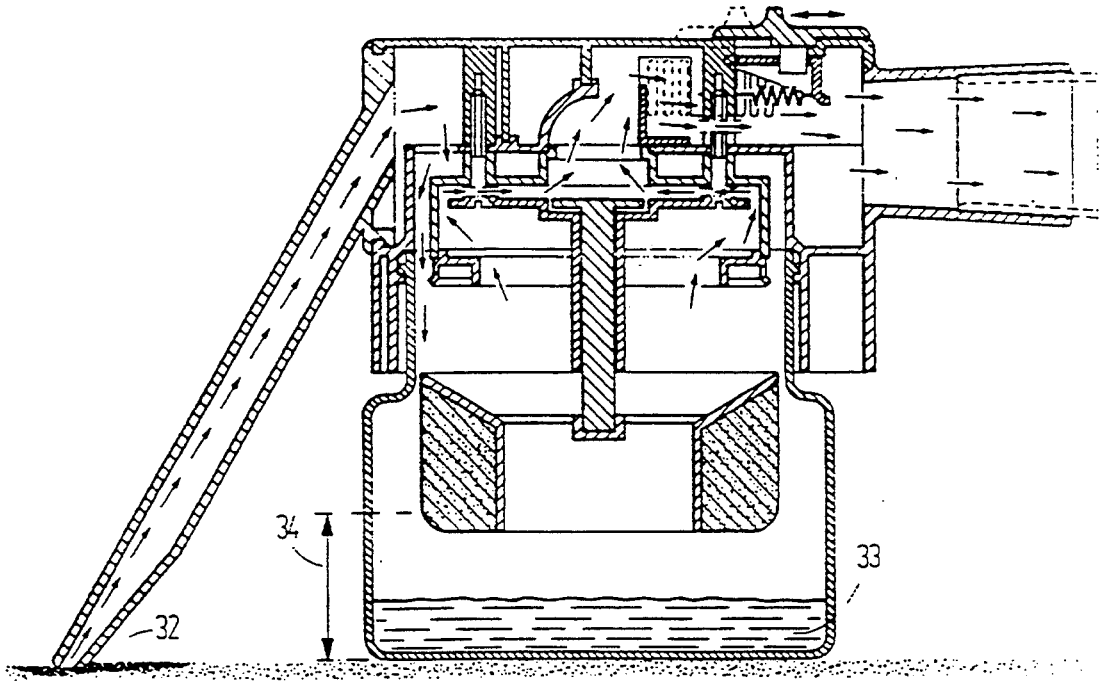
FIG. 4 shows the attachment during suction.
Figure 5:
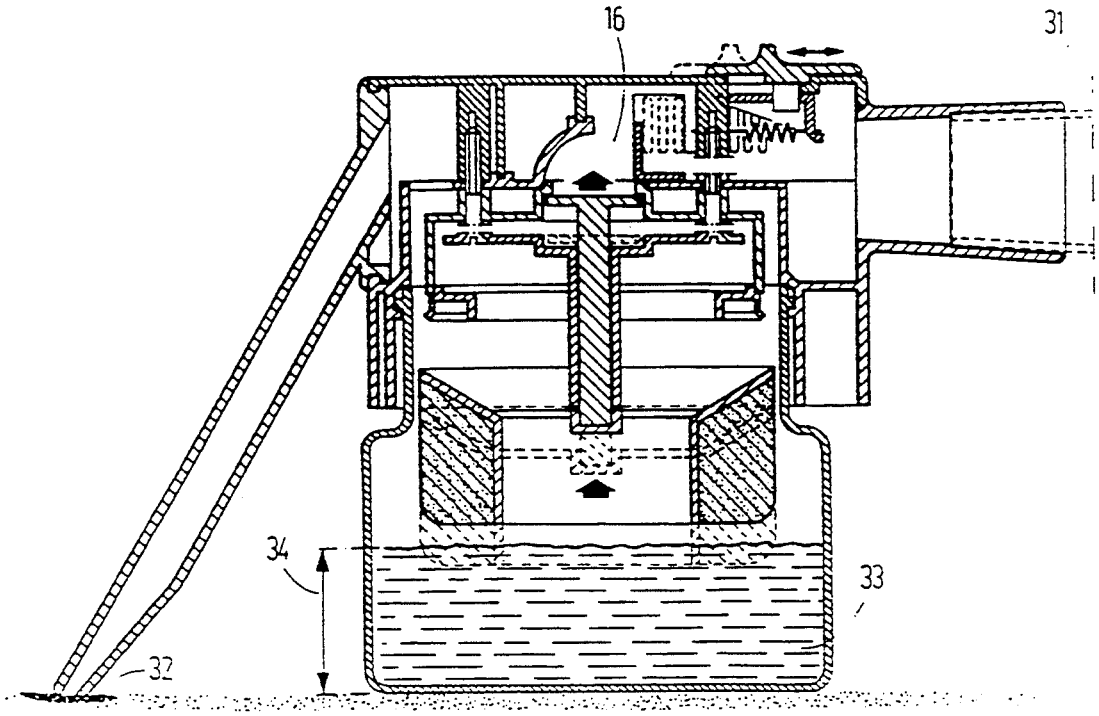
FIG. 5 shows the attachment with the float-controlled valve closed.

As shown in FIG. 1, the attachment is configured as a portable container 1, above which there is a hose stub 27 to which a vacuum cleaner hose or vacuum-cleaning pipe see FIGS. 4 and 5, can be connected.

In the cross-sectional view in FIGS. 2–5, it can be seen how the attachment is arranged. On the front of the container 1 there is provided a swivel link 28 in which a suction nozzle 29, which extends some distance outwards from the container, is mounted in such a manner that it forms a pivotable suction channel 30 for the liquid.

Figure 2:
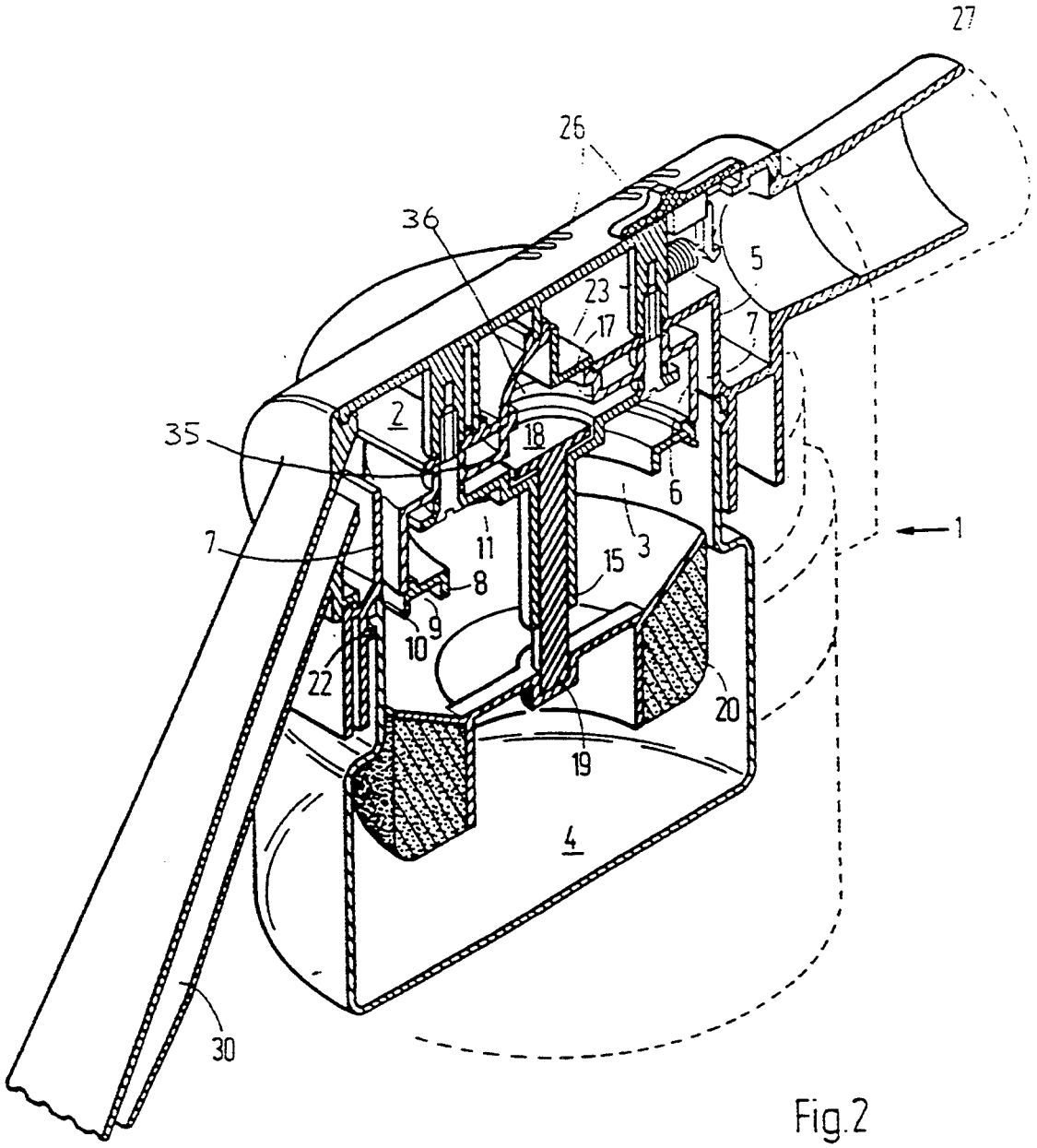
FIG. 2 shows the attachment in cross-section.

As indicated in FIG. 2, openings are configured anteriorly. Dust traps which are not shown could also be provided in the nozzle to prevent nap and the like from being sucked into the container 1.

Figure 3:
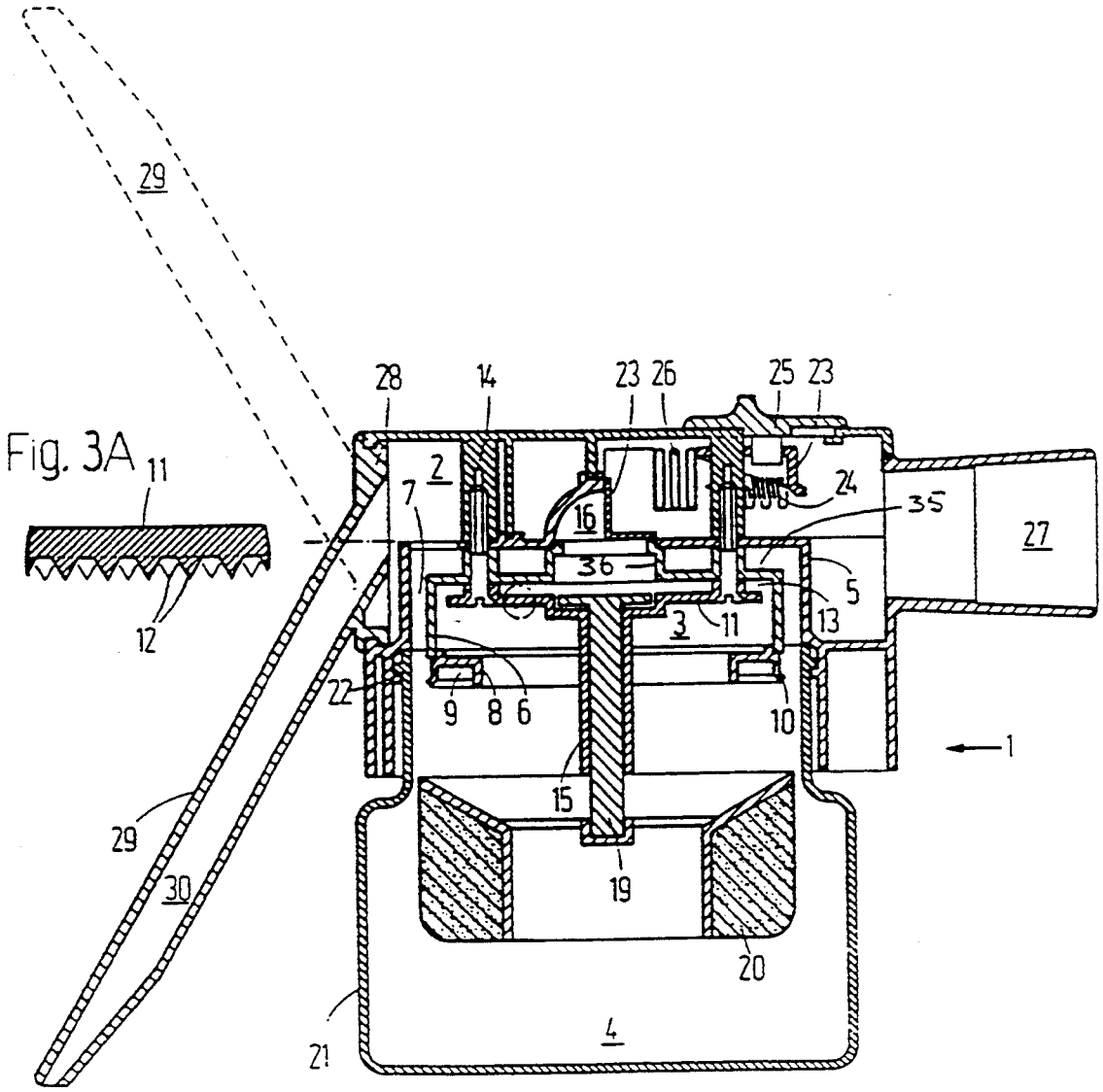
FIG. 3 shows the attachment before it is taken into use.

As shown by the dashed line in FIG. 3, the nozzle 29 can be turned to the sides, enabling the vacuuming of inclined surfaces, e.g. on furniture.

In the top of the container there is mounted a valve 17, 18 and a separation chamber 3. The separation chamber is arranged in such a manner that the liquid, when vacuumed, is effectively separated from the air and collected in a lower chamber 4 which is formed in the container 21. By means of a fitting 22, which may be a threaded fitting, the container can be secured to the upper part of the container so that the container can be taken off and emptied of liquid 33.

The separation chamber is formed as a channel comprising a suction connection 2 placed after the swivel link 28, the bottom ,of said suction connection 2 opening into an annular chamber 7 having an outer side wall 5 consisting partly of the chamber and partly of the upper part of the collection container 21, and an inner wall 6 with lower portions which end in a drip edge 10. The bottom of this inner wall 0 is provided with a further inner annular wall 8 to form a downwardly-open gutter channel 9.

The walls and the chambers all open over the collection chamber 4. The exit from the chamber is through a horizontal chamber 13 which is formed between a circular plate 11, which is secured by means of screws to a number of stays 14 in the top of the chamber, and an upper plate 35, which in the middle is provided with an upwardly-extending stub 36 which opens into a discharge opening 16.

As shown in the partial enlargement in FIG. 3, the underside of the plate 11 is provided with drip cones 12.

The middle of the plate is configured with a guide 15 which extends downwards into the container 1. As shown in FIG. 5, a valve element 18 is suspended above the guide so that it can move upwards and close the discharge opening 16.

To the valve element 18 there is secured a spindle 19 which can slide in the guide 15, and which at the bottom supports a float element 20 which consists mainly of a ring of synthetic foam material secured in a holder.

As will appear from FIG. 5, the float element 20 is moved upwards when the liquid reaches the level 34, and the vacuum in the discharge opening 16 will thereby instantly cause the valve element 18 to close to all further suction through the container 1.

The float element 20 is very light, so if the container is tilted the valve can close before liquid can manage to run into the discharge opening and the suction hose 31 and possibly damage the vacuum cleaner.

On the top there is mounted a finger-operated valve comprising a valve element 23, the front of which closes the discharge opening 16 by means of a tension spring 24 which is secured to one stay 14.

The valve element 23 is additionally provided with a number of slotted openings 25 which match corresponding openings in the top of the container, so that access is provided for air from the outside to the suction connection 27 when the valve is closed, as shown in FIGS. 2 and 3.

When the attachment is to be used for vacuuming up an accumulation of liquid 32, for example on a carpet, the suction nozzle 29 is swivelled down with its end placed in the liquid. At the same time, the finger-operated valve is opened by sliding back the button 25, as shown in FIG. 4 Access for the air from outside through the openings 26 is thereby cut off, and a suction of the liquid can commence when the vacuum cleanest or the suction is activated.

When the liquid reaches the separation chamber 3, it impacts against the walls in the channel system and its velocity is reduced, whereby the liquid molecules and droplets are deposited on the walls, after which the liquid runs downwards and is collected in the container.

After a period of time the surface of the liquid in the container will reach a given level 34, as shown in FIG. 5, whereby the float element 20 will be lifted upwards. The valve element 18 will thus cut off the vacuum through the attachment and prevent liquid from flowing to the vacuum hose. Hereafter, the valve button 25 can be released and the outside air will flow to the vacuum hose 31, whereby the vacuum cleaner is spared.

As mentioned earlier, this will also happen if the container is tilted such that there is a risk of liquid reaching the discharge opening 16.

By means of this attachment and an ordinary vacuum cleaner, liquid will thus be able to be vacuumed up in an effective manner without any significant reduction in the suction effect, and without this induction of the liquid giving rise to any risk of damage to the vacuum cleaner.

The attachment will be made mainly of synthetic materials, and since there is no significant wear on the parts, it will be inexpensive to produce and will have a long lifetime.

I claim:

1. An attachment for a vacuum cleaner or a vacuum cleaning pipe, the attachment used for collecting vacuumed liquid, and comprising a closed container having a suction connection for connection to a nozzle, and having a vacuum connection for connection to the vacuum cleaner or the vacuum cleaning pipe, a separation chamber provided in the container and connected to the suction connection for separating the vacuumed liquid from suction air, a collection chamber provided in the container for collecting the separated liquid, a float control valve located between the collection chamber and the vacuum connection, the suction connection placed in a top of the container such that it opens into the separation chamber, the separation chamber forming a channel defined by vertical and horizontal walls on which the liquid is separated from the suction air, the walls located above the collection chamber, the vertical wall surfaces having drip edges at the bottom thereof, the horizontal wall surfaces having drip cones thereon.

2. The attachment according to claim 1, further comprising a horizontal chamber having an underside consisting of a first plate and a top consisting of a second plate, an upwardly extending stub located in the middle between the plates, the stub opening into a discharge opening such that the exit from the separation chamber to the vacuum connection takes place through the horizontal chamber.

3. The attachment according to claim 1, wherein the float control valve is located in the separation chamber, close to the vacuum connection, the float control valve having a valve spindle which extends downwardly into the collection chamber, the valve spindle connected to a float element.

4. The attachment according to claim 1, further comprising a finger operated valve located between the float control valve and the vacuum connection, the finger operated valve including a slide member which provides access for air from outside through openings into the container when the vacuum is cut off, the finger operated valve, when closed, opens suction into the container.

5. The attachment according to claim 2, wherein the float control valve is located in the separation chamber, close to the vacuum connection, the float control valve having a valve spindle which extends downwardly into the collection chamber, the valve spindle connected to a float element.

6. The attachment according to claim 2, further comprising a finger operated valve located between the float control valve and the vacuum connection, the finger operated valve including a slide member which provides access for air from outside through openings into the container when the vacuum is cut off, the finger operated valve, when closed, opens suction into the container.

7. The attachment according to claim 3, further comprising a finger operated valve located between the float control valve and the vacuum connection, the finger operated valve including a slide member which provides access for air from outside through openings into the container when the vacuum is cut off, the finger operated valve, when closed, opens suction into the container.

* * * * *